US009358448B1

(12) United States Patent
Brown

(10) Patent No.: US 9,358,448 B1
(45) Date of Patent: Jun. 7, 2016

(54) POOL GAME

(71) Applicant: Rodger O. Brown, Cape Girardeau, MO (US)

(72) Inventor: Rodger O. Brown, Cape Girardeau, MO (US)

( * ) Notice: Subject to any disclaimer, the term of this patent is extended or adjusted under 35 U.S.C. 154(b) by 196 days.

(21) Appl. No.: 13/672,430

(22) Filed: Nov. 8, 2012

Related U.S. Application Data

(60) Provisional application No. 61/557,663, filed on Nov. 9, 2011.

(51) Int. Cl.
*A63F 7/00* (2006.01)
*A63F 7/02* (2006.01)

(52) U.S. Cl.
CPC ..... *A63F 7/02* (2013.01)

(58) Field of Classification Search
CPC ..... A63F 7/00; A63F 7/0005; A63F 7/02; A63F 7/36
USPC ..... 273/118 R–126 A; 473/6, 10, 14, 18, 20
See application file for complete search history.

(56) References Cited

U.S. PATENT DOCUMENTS

| | | | | |
|---|---|---|---|---|
| 1,319,799 | A | 10/1919 | Sauper | |
| 1,552,469 | A | 9/1925 | Conway | |
| 1,612,912 | A * | 1/1927 | Esmarian | 273/125 A |
| 1,615,899 | A * | 2/1927 | Bjorkman | 473/18 |
| 1,693,116 | A | 11/1928 | Lee | |
| 2,102,807 | A | 12/1937 | Perks | |
| 3,544,108 | A * | 12/1970 | Bali | 473/18 |
| 3,768,810 | A | 10/1973 | Goldfarb et al. | |
| 3,800,443 | A | 4/1974 | O'Connell et al. | |
| 3,897,951 | A * | 8/1975 | Morrison et al. | 273/121 A |
| 3,902,720 | A * | 9/1975 | Collins | 473/83 |
| 3,926,435 | A | 12/1975 | Nacci | |
| 3,958,804 | A | 5/1976 | Godfrey | |
| 4,162,793 | A * | 7/1979 | Cummings | 273/121 A |
| 5,066,014 | A | 11/1991 | Dobson | |
| 5,169,317 | A | 12/1992 | Hollander | |
| 5,314,367 | A | 5/1994 | Schaefer | |
| 5,405,144 | A * | 4/1995 | Ritchie et al. | 273/121 A |
| 5,445,376 | A | 8/1995 | Bromley | |
| 6,093,428 | A | 7/2000 | Hoeting et al. | |
| 6,220,598 | B1 | 4/2001 | Kweitko et al. | |
| 6,786,833 | B2 * | 9/2004 | Ahrend | 473/265 |
| 7,429,217 | B1 | 9/2008 | Lawrence | |
| 2005/0073092 | A1 * | 4/2005 | Oister et al. | 273/119 R |
| 2007/0210215 | A1 | 9/2007 | Prest | |

* cited by examiner

*Primary Examiner* — Sebastiano Passaniti
(74) *Attorney, Agent, or Firm* — Polsinelli PC

(57) ABSTRACT

A playing surface for a pool or billiards style game that includes variable margins. The playing surface includes a first end and second end. The second end includes a scoring hole. A first ball is struck by a second ball in order to roll the first ball along the playing surface, in between the variable margins, in order to sink the first ball in the scoring hole.

21 Claims, 5 Drawing Sheets

POOL GAME

This application claims the benefit of U.S. Provisional Patent Application No. 61/557,663 filed Nov. 9, 2011.

FIELD OF THE INVENTION

The present invention relates to a pool and billiards type recreational game and playing surface. The game utilizes a unique playing surface with variable margins along a center region.

SUMMARY OF THE INVENTION

A playing surface for a pool or billiards type game is herein described. Gaming devices including the playing surface are described herein. The playing surface is elevated in a generally horizontal manner. The playing surface includes variable margins on a left and a right side of a center region. A first ball or game ball is positioned on a first end of the playing surface. A second ball or cue ball is placed on the first end of the playing surface adjacent the first ball and opposite of the center region. The object of the game is to sink the first ball or game ball into a scoring hole in a second end of the playing surface by striking the first ball with the second ball. The second end is on the opposite side of the playing surface as the first end. Similar to regular pool, the second ball, or cue ball, is struck with a pool stick or cue causing the second ball to strike the first ball and to propel the first ball along the playing surface. The first ball needs to travel down the center region in order to reach the scoring hole, otherwise the first ball will fall off of the playing surface at the variable margins. The variable margins fluctuate in width along the length of the center region. If the first ball veers from the center region, it may fall from the playing surface.

In one aspect, a playing surface for a gaming device is described. The playing surface includes a generally flat member having an upper surface. A center region of the flat member is bounded by a front edge, a back edge, a left edge, and a right edge. A left lateral margin along the left edge extends to a left side of the center region. The left lateral margin includes a first shape. A right lateral margin along the right edge extends to a right side of the center region. The right margin includes a second shape.

In another aspect, a playing surface for a gaming device is described. The playing surface includes a center region. A first end of the center region is oppositely disposed of a second end of the center region. Curving regions are on left and right sides of the center region. The curving regions form edges of the playing surface. A hole is in the second end.

In a further aspect, a pool game is described. The pool game includes a generally flat playing surface. The playing surface includes a first end oppositely disposed of a second end. The playing surface includes a center region that connects the first end and the second end. The playing surface includes variable margins on lateral sides of the center region. The variable margins form edges of the playing surface. A scoring hole is positioned in the second end. The first end of the playing surface receives a first ball and a second ball.

In a further aspect, a pool game is described. The pool game includes a playing surface. The playing surface includes a first end oppositely disposed of a second end. The playing surface includes variable margins that form edges of the playing surface. A main scoring hole is in the second end. A scoring ramp is positioned below the playing surface. The scoring ramp includes one or more scoring holes. A ball return ramp is positioned below the scoring ramp.

In other aspects, the playing surface gaming may be enclosed in a housing with a first end of the playing surface accessible for shooting the balls. Any of a variety of electronic and mechanical monitoring systems may be used to maintain a score for the game.

DETAILED DESCRIPTION OF PREFERRED EMBODIMENTS

Figure 1:
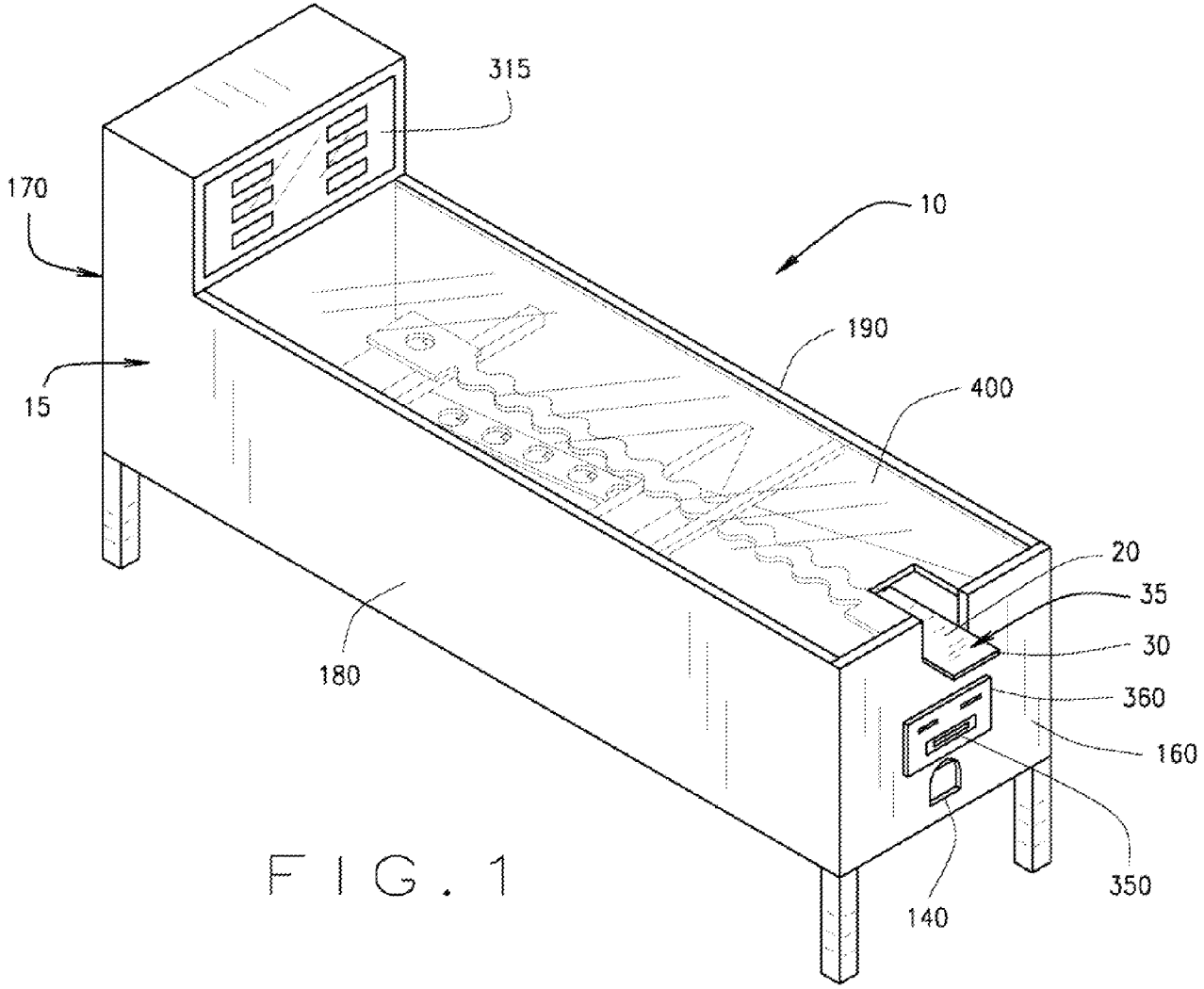
FIG. 1 is a perspective view of the gaming device.
Figure 2:
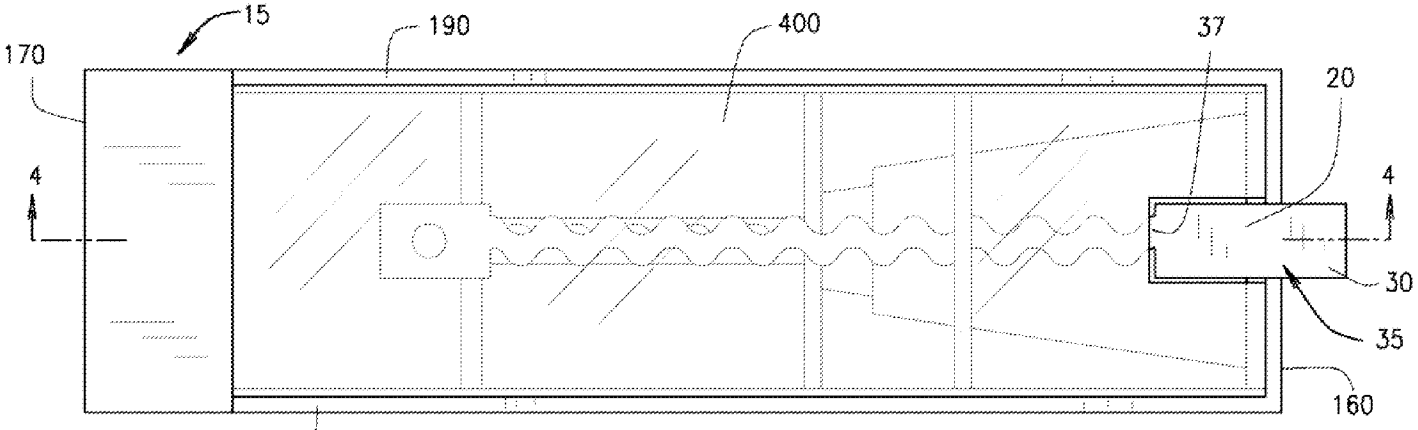
FIG. 2 is a top-down view of the gaming device.
Figure 3:
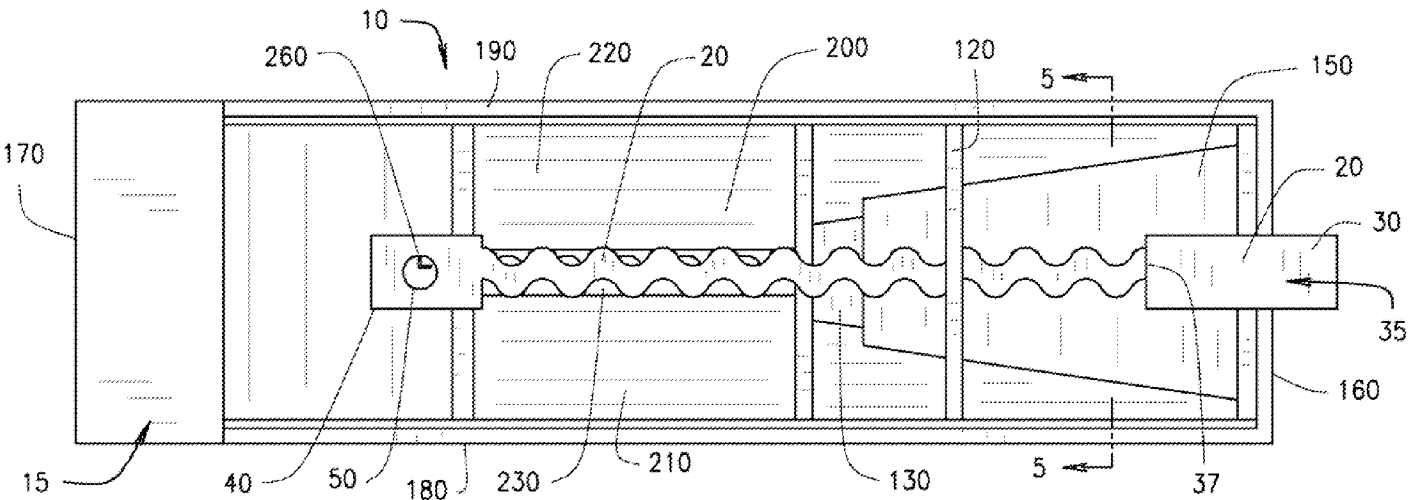
FIG. 3 is a top-down view of the gaming device with the cover removed.
Figure 4:
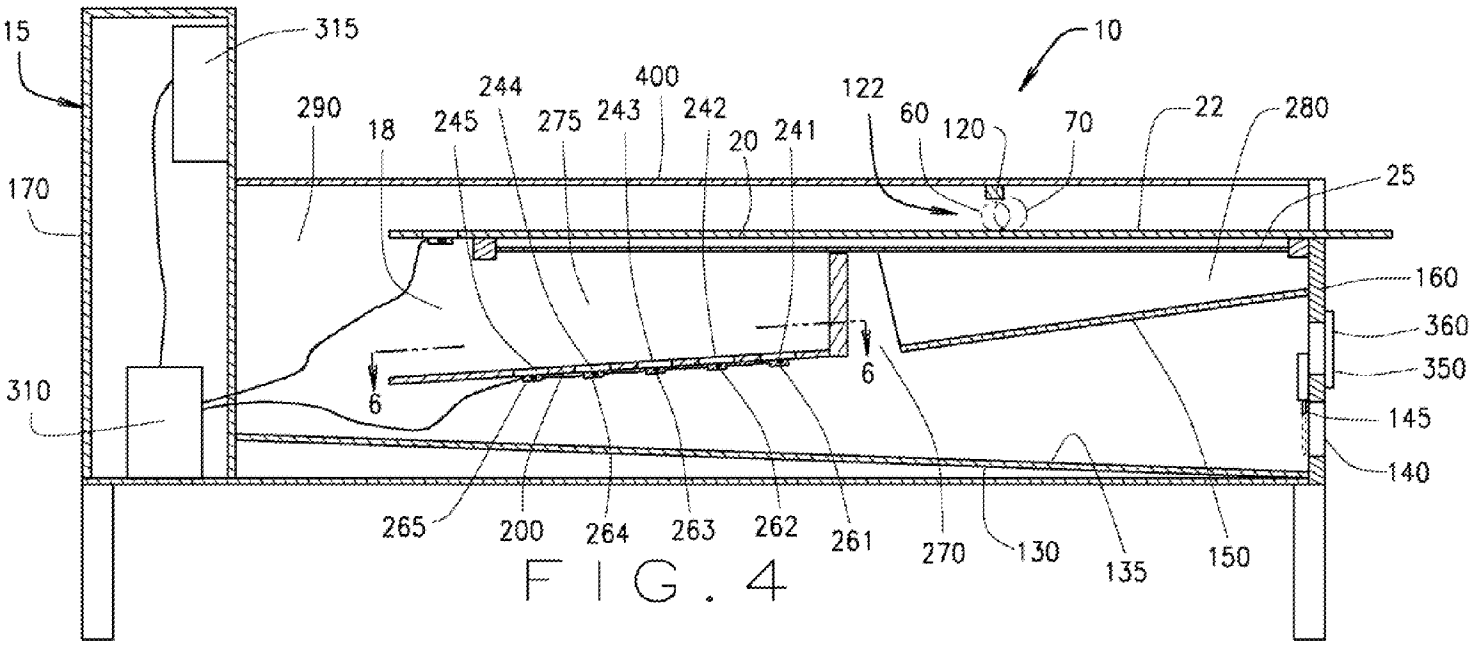
FIG. 4 is a side-sectional view of the gaming device.
Figure 5:
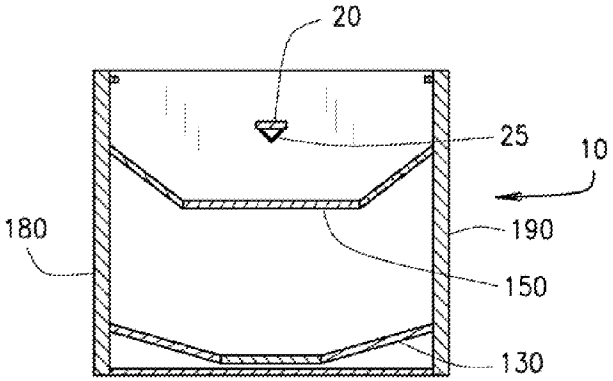
FIG. 5 is a front sectional view of the gaming device.
Figure 6:
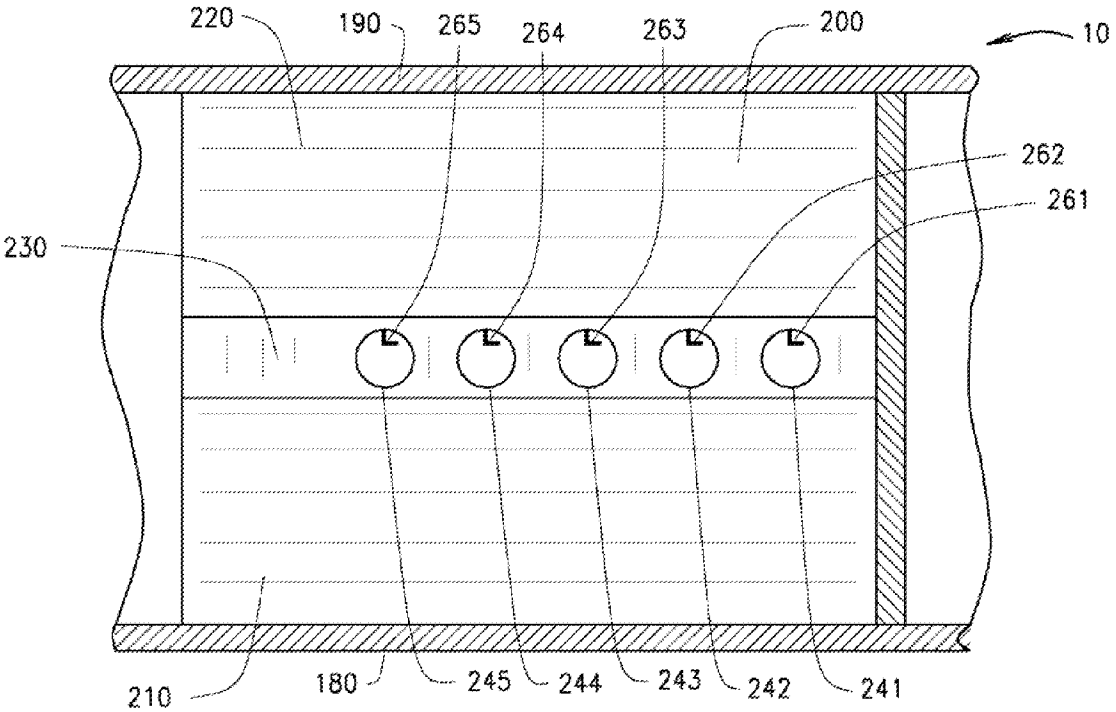
FIG. 6 is a sectional view showing the scoring ramp.

A game and playing surface will now be described with reference to FIGS. 1-9. A gaming device 10 includes a playing surface 20 having a first end 30 and a second end 40. The playing surface 20 is a generally flat member having an upper playing surface 22. The first end 30 of the playing surface 20 includes a striking area 35. The second end 40 of the playing surface 20 includes a main scoring hole 50 that is to receive a first ball 60 that has been struck by a second ball 70. In between the first end 30 and the second end 40 of the playing surface 20, the playing surface 20 includes multiple curves and/or bends in margins or sides of the playing surface 20. The multiple curves and/or bends form boundaries or edges of the playing surface 20.

Figure 8:
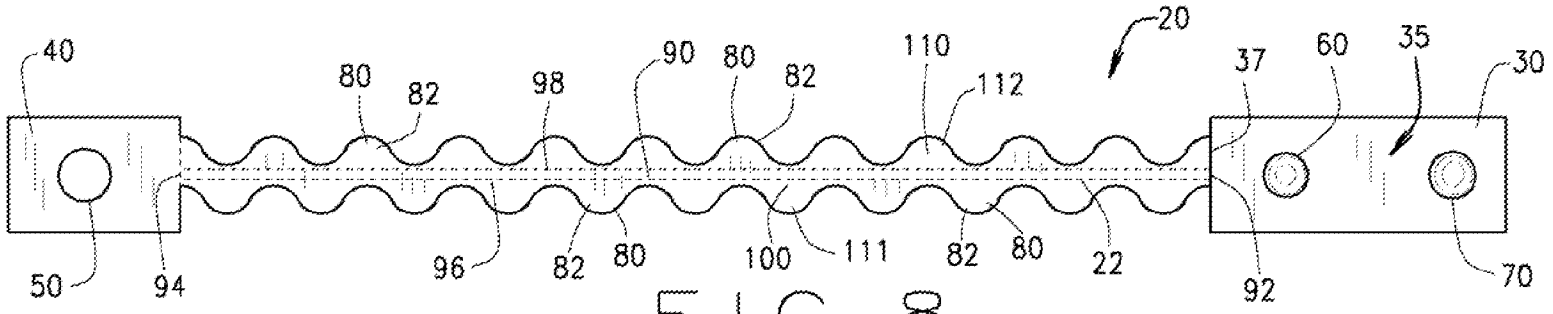
FIG. 8 is a top down view of the playing surface showing the center region.
Figure 9:
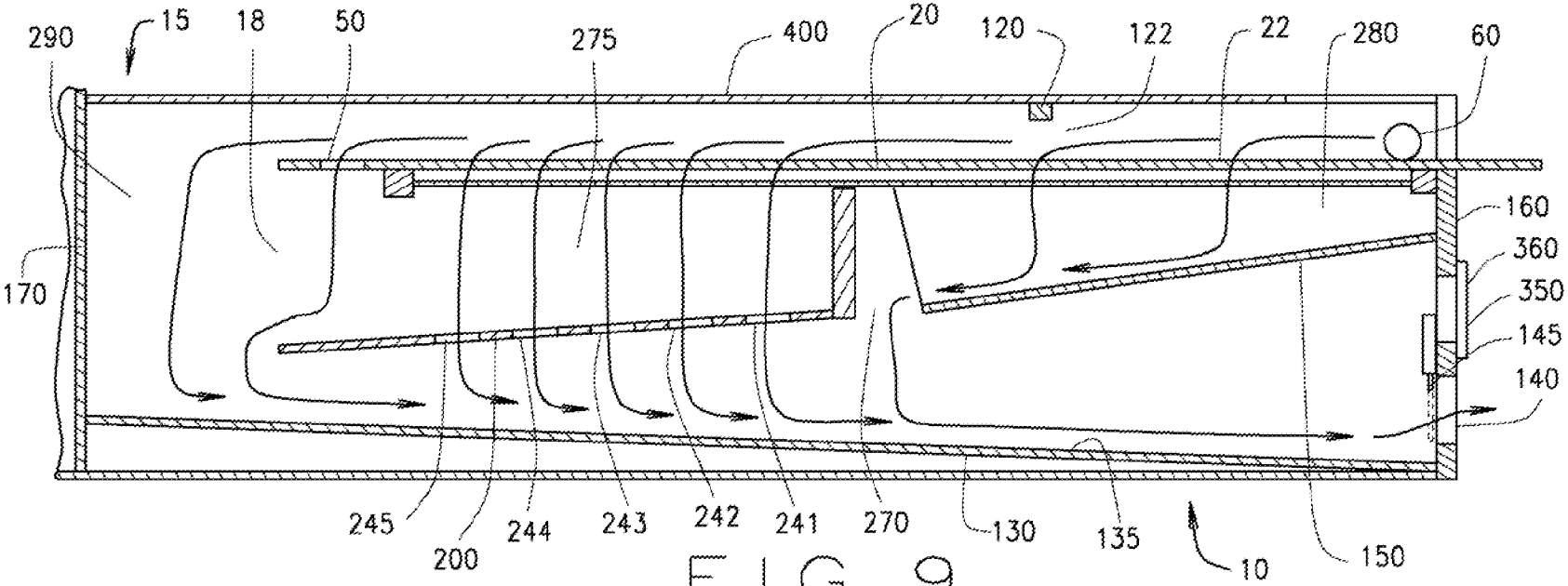
FIG. 9 is a side-sectional view of the gaming device showing ball movement in the interior of the gaming device.

The multiple curves and/or bends in the margins or sides of the playing surface 20 increase the difficulty in directing the first ball 60 into the main scoring hole 50. For example, as shown in FIG. 8, the playing surface 20 includes approximately ten curving regions 80 per side. The curving regions 80 may have a sin wave shape. The curving regions 80 are positioned on the sides of a center region 90 that connects the first end 30 to the second end 40. The curving regions 80 form the left and right lateral edges of the playing surface 20. The curving regions 80 may be staggered relative to each other. The curving regions 80 also have a generally flat upper surface 82. The flat upper playing surface 22 is co-planar with the upper surface 82. The flat upper playing surface 22 and the flat upper surface 82 are entirely free of or mostly free of any obstacles that would prevent the ball 60 from falling off of the surfaces 22 and 82.

In other aspects, the number of curving regions 80 may be increased or decreased depending upon the size of the gaming device 10, as well as the playing difficulty desired. The curving regions 80 are positioned to the sides of a center line 91 of the center region 90 that connects the first end 30 to the second end 40. The center line 91 generally forms an X axis of the sin curve. The center region 90 generally forms a long and narrow rectangular path to the main scoring hole 50. With reference to FIG. 8, lateral portions of the playing surface 20 intermittently widen and narrow between the first end 30 of the playing surface 20 and the second end 40 of the playing surface 20. As such, the margins of the playing surface 20 intermittently fluctuate in width in the X direction along the sin wave formed by the curving regions 80. Although the margins of the playing surface 20 fluctuate, the margins also include a generally flat playing surface.

The playing surface 20 is formed from a generally flat sheet. With reference to FIG. 8, the playing surface 20 includes the center region 90 on its upper surface 22. The center region 90 is approximately bounded by a front edge 92, a back edge 94, a left edge 96, and a right edge 98. A left lateral margin 100 along the left edge 96 extends to a left side of the center region 90. The left lateral margin 100 comprises a first shape 111, which in this aspect, is a curve. A right lateral margin 110 along the right edge 98 extends to a right side of the center region 90. The right margin 110 comprises a second shape 112, which in this aspect, is also a curve. The left and right lateral margins 100 and 110 may repeat the first and the second shapes 111 and 112. The left margin 100 and the right margin 110 may comprise a repeating pattern of the first shape 111 and the second shape 112. The patterns of the first shape 111 and the second shape 112 may be offset resulting in lateral asymmetry between the patterns along the length of the center region 90. The first and second shapes 111 and 112 may be polygons, conic sections, sinusoidal curves, or combinations thereof. Other shapes may be utilized. The first and second shapes 111 and 112 may be the same or different.

A blocker 120 generally extends the width of the gaming device 10. The blocker 120 is positioned over the playing surface 20 with a space 122 between the playing surface 20 and the blocker 120. The blocker 120 stops the second ball 70 from moving down the playing surface 20. The second ball 70 has a slightly larger diameter than the first ball 60. The first ball 60 passes under the blocker 120 and through the space 122, while the second ball 70 is stopped by the blocker 120.

The gaming device 10 includes a housing 15. The housing 15 generally includes a front wall 160 opposite of an end wall 170. The front wall 160 is closer to the front end 30, while the end wall 170 is closer to the second end 40. The housing 15 further generally includes a first sidewall 180 opposite of a second sidewall 190. A covering 400 generally covers a top side of the gaming device 10. The covering 400 maintains the balls 60 and 70 in the gaming device 10 and helps to prevent unauthorized interference with the interior portions of the gaming device 10. The covering 400 may be made from Plexiglas or other transparent, impact-resistant materials. A combination of the front wall 160, the end wall 170, the first sidewall 180, the second sidewall 190, and the covering 400 define an interior 18 of the gaming device 10.

The playing surface 20 is supported by a support member 25. The playing surface 20 is over the interior 18 of the gaming device 10. The playing surface 20 is positioned approximately 3-5 feet above the ground. The playing surface 20 may have a length of approximately 5 feet to approximately 10 feet, depending upon the preference of the manufacturer.

During game play, the first and second balls 60 and 70 may fall from the playing surface 20 into the interior 18. A ball return ramp 130 receives and directs the first and/or second balls 60 and 70 to a ball return opening 140. The ball return ramp 130 is angled relative to the ground and gravity acts to direct the balls 60 and 70 toward the first end 30 of the game 10. The ball return ramp 130 also receives the ball 60 that has passed through the main scoring hole 50.

The ball return ramp 130, a scoring ramp 200, and a no-score ramp 150 are generally positioned in the interior 18 of the gaming device 10. The scoring ramp 200 registers scores for balls 60 that have rolled over a substantial portion of the playing surface 20 before falling off of the playing surface 20. The no-score ramp 150 directs balls 60 to the ball return ramp 130 that have not covered a substantial portion of the playing surface 20 before falling off.

A gap 270 is provided between the no-score ramp 150 and the scoring ramp 200. The gap 270 provides a passage for the ball 60 to fall from the no-score ramp 150 to the ball return ramp 130. The ball return ramp 130 angles downward toward a front of the gaming device 10 and directs the ball 60 to the ball return opening 140. The ball return ramp 130 generally extends from the end wall 170 to the front wall 160. The ball return ramp 130 generally angles downward toward the front wall 160.

Figure 7:
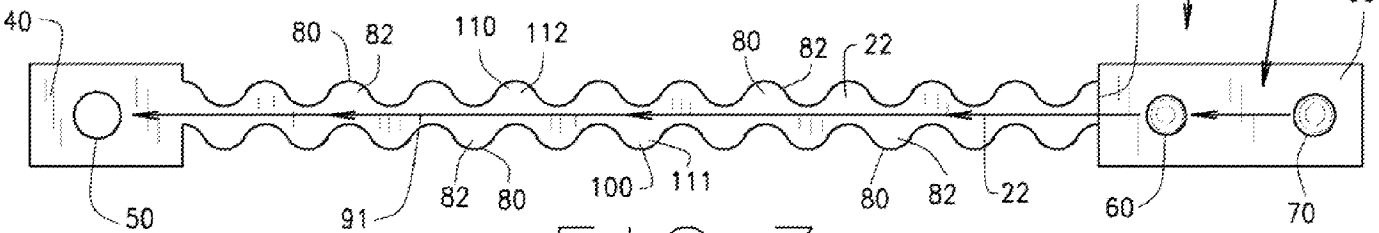
FIG. 7 is a top down view of the playing surface showing ball movement on the playing surface.

As shown in FIG. 7, during play with the gaming device 10, the user places the first ball 60 or game ball behind a start line 37 on the first end 30 of the playing surface 20. The user then places the second ball 70 or cue ball behind the first ball 60, i.e., the first ball 60 is between the start line 37 and the second ball 70. The user strikes the second ball 70 with the cue stick to propel the second ball 70 toward the first ball 60 to hit the first ball 60 and direct the first ball 60 down the center region 90 between the lateral margins 100 and 110 of the playing surface 20. The object is to sink the first ball 60 into the main scoring hole 50 in the second end 40 without the first ball 60 falling off of the sides of the playing surface 20. The curving regions 80 along the center region 90 provide an optical illusion and/or visually interfere with the alignment of the shot to make for a challenging game. As previously described, the blocker 120 prevents the second ball 70 from proceeding to the main scoring hole 50 and to the scoring ramp 200.

The scoring ramp 200 is positioned underneath the playing surface 20. The scoring ramp 200 receives the ball 60 when the ball 60 has fallen off of the playing surface 20 in a scoring region 275 of the gaming device 10. The scoring region 275 generally includes the portion of the playing surface 20 over the scoring ramp 200. The scoring ramp 200 includes a first lateral side 210 and a second lateral side 220 that angle towards a central portion 230. The first and second lateral sides 210 and 220 direct the ball 60 to the central portion 230. The central portion 230 includes a plurality of secondary scoring holes. For example, with reference to FIG. 6, the central portion 230 includes a first scoring hole 241, a second scoring hole 242, a third scoring hole 243, a fourth scoring hole 244, and a fifth scoring hole 245. The scoring holes 241, 242, 243, 244, and 245 are lined up in a linear manner in the central portion 230. The scoring holes 241, 242, 243, 244, and 245 may be equally spaced apart on the scoring ramp 200. Each of the scoring holes 50, 241, 242, 243, 244, and 245 includes, respectively, a ball sensor 260, 261, 262, 263, 264, and 265. Each of the ball sensors 260, 261, 262, 263, 264, and 265 detects when the ball 60 has passed through its respective scoring hole 50, 241, 242, 243, 244, and 245. For example, if the game ball 60 passes through the third scoring hole 243, then the ball sensor 263 is triggered.

The scoring ramp 200 is also positioned over the ball return ramp 130. The scoring ramp 200 angles downward toward a rear of the gaming device 10. After the ball 60 passes through one of the scoring holes 50, 241, 242, 243, 244, and 245 and registers a score, the ball 60 drops to an upper surface 135 of the ball return ramp 130, which directs the ball 60 to the ball return opening 140.

The ball sensors 260, 261, 262, 263, 264, and 265 may include any of a variety of electrical or mechanical sensors, switches, or detectors that detect, sense, monitor or are otherwise triggered by the ball 60 passing through the respective scoring holes 50, 241, 242, 243, 244, and 245. For example, the ball sensors 260, 261, 262, 263, 264, and 265 may include wire switches that are triggered by the physical impact of the ball 60 passing through the scoring hole 50, 241, 242, 243, 244, and 245. For example, the ball sensors 260, 261, 262, 263, 264, and 265 may emit and receive light beams that may be tripped by the passing ball 60 to indicate that the ball 60 has passed through the respective scoring holes 50, 241, 242, 243, 244, and 245. The ball sensors 260, 261, 262, 263, 264, and 265 are in electrical communication with a processing unit 310. The ball sensors 260, 261, 262, 263, 264, and 265 signal the processing unit 310 when the ball 60 has passed through the respective scoring holes 50, 241, 242, 243, 244, and 245.

In game play, the main scoring hole 50 and the scoring holes 241, 242, 243, 244, and 245 may be assigned the same or different point values. For example, in one aspect, the first scoring hole 241 is worth 100 points, the second scoring hole 242 is worth 200 points, the third scoring hole 243 is worth 300 points, the fourth scoring hole 244 is worth 400 points, and the fifth scoring hole 245 is worth 500 points. The main scoring hole 50 is worth 1000 points. As the player scores points, the processing unit 310 will display the points scored on a monitor 315. As such, the player earns more points for getting the ball 60 farther down the playing surface 20.

The ball return opening 140 is positioned in the front wall 160 of the gaming device 10. A gate 145 selectively opens and closes the ball return opening 140 to allow and conclude game play. For example, the gaming device 10 may be programmed to allow the player three scores. The gate 145 may remain open until the three scores are registered by the processing unit 310. For example, in one aspect, after the three scores are registered by the processing unit 310, the gate 145 will close and the gaming device 10 will be in a "game over mode" until additional money is received by a money acceptor 350.

The gaming device 10 may also include one or more no-score regions. A first no-score region 280 is adjacent to the first end 30 of the playing surface 20. The first no-score region 280 will tend to receive balls 60 that are poorly struck, as these balls 60 have fallen from the playing surface 20 after rolling over only a small portion of the playing surface 20.

In the first no-score region 280, the ball 60 falls from the playing surface 20 to the no-score ramp 150, which is positioned over the ball return ramp 130. The second ball 70, which is stopped by the blocker 120, also may fall to the no-score ramp 150. The no-score ramp 150 may be positioned underneath a first portion of the playing surface 20 nearest the first end 30. For example, the no-score ramp 150 may be under approximately the first third to approximately the first half of the playing surface 20. In other aspects, the no-score ramp 150 may be lengthened. The no-score ramp 150 angles downward toward a rear of the gaming device 10, and the no-score ramp 150 directs the balls 60 and/or 70 to the ball return ramp 130, which further directs the balls 60 and/or 70 to the ball return opening 140. When the balls 60 and/or 70 fall off of the playing surface 20 over the no-score ramp 150, then balls 60 and/or 70 are returned to the ball return opening 140 without registering a score.

A second no-score region 290 is between the end wall 170 and the second end 40. When the ball 60 is struck with sufficient force and a specific trajectory, the ball 60 may miss the main scoring hole 50 and roll off the playing surface 20 near the second end 40 and/or strike the end wall 170. The second no-score region 290 drops the ball 60 on the ball return ramp 130 without registering a score. As such, the scoring region 275 is positioned between the first non-scoring region 280 and the second non-scoring region 290.

The front wall 160 of the gaming device 10 includes the money acceptor 350 and a user interface 360 for the player to pay for and choose the type of game that they wish to play on the gaming device 10. The monetary acceptor 350 may accept change, tokens, and/or bills. The monetary acceptor 350 may also include an opening for the player to swipe or insert a credit card or a pre-paid gaming card in order to pay for game play on the gaming device 10.

The gaming device 10 may be utilized as a game of chance or skill at a carnival, fair, or the like. For example, in order to win a prize, a user may buy three chances to sink the first ball 60 into the main scoring hole 50. In other embodiments, the gaming device 10 may incorporate a point scoring system to provide an amusement device that may be used in arcades, bars, restaurants, and the like. For example, a point total may be assigned for every time the first ball 60 is dropped into the main scoring hole 50 or the other scoring holes 241, 242, 243, 244, and 245. Software may be incorporated into the processing unit 310 to monitor current scores, high scores, teams, players, game plays, remaining money, etc.

The processing unit 310 may be programmed with a variety of different game modes. For example, one or two player modes, team modes, and party modes may all be programmed into the processing unit 310. The processing unit 310 is in electrical communication with the monitor 315 to display game results. The user interface 360 may include buttons, control knobs, and/or digital displays to assist the player in making their specific game or mode selection and inputting their selections into the processing unit 310.

The main scoring hole 50 may have a diameter of approximately 2¾ inches to receive the first ball 60. The center region 90 may have a width of approximately ½ inch to 1½ inches. The playing surface 20 may have a width of approximately 1 to approximately 6 inches. The relative size of the main scoring hole 50 and the widths of the playing surface 20 and the center region 90 may be adjusted depending upon the skill level desired for the game. Each of the first end 30 and the second end 40 may form by a rectangular shape having a length of approximately 9 inches and a width of approximately 6 inches.

The game 10 may be used with standard pool balls, as well as standard pool cues. The playing surface 20 may be formed by layering or laminating conventional pool table felt or felt-like materials onto a planar piece of material, such as sheet metal, plastic, wood or other composite material. Additional supports may be included to hold and support the playing surface 20.

The gaming device 10 may include four or more adjustable legs. Each of the legs may be provided with adjustable feet that are threadably received by ends of the legs. This allows the height of each of the legs to be increased or decreased to assist in leveling the playing surface 20. This allows the angle of the playing surface 20 to be adjusted and tightened to maintain a level playing surface 20.

The invention claimed is:

1. A playing surface for a gaming device, comprising:

a generally flat member having an upper surface with a level orientation, wherein a center region of the flat member is bounded by a front edge, a back edge, a left edge, and a right edge;

a left lateral margin along the left edge and extending to a left side of the center region, the left lateral margin comprising a first shape that forms a first flat upper playing surface that is coplanar with the upper surface; and, a right lateral margin along the right edge and extending to a right side of the center region, the right margin comprising a second shape that forms a second flat upper playing surface that is coplanar with the upper surface; and, a first end of the generally flat member oppositely disposed of a second end of the generally flat member, the center region connects the first end and the second end, the center region comprising a straight path between the first end and a hole of the second end; and, the playing surface is configured to allow playing balls to fall from the playing surface.

2. The playing surface according to claim 1, wherein the left margin repeats the first shape, and wherein the right margin repeats the second shape.

3. The playing surface according to claim 1, wherein the left margin comprises a repeating pattern of the first shape, and wherein the right margin comprises a repeating pattern of the second shape.

4. The playing surface according to claim 3, wherein the repeating pattern of the first shape and the repeating pattern of the second shape are offset.

5. The playing surface according to claim 3, wherein the repeating pattern of the first shape and the repeating pattern of the second shape are offset resulting in lateral asymmetry between the first repeating pattern and the second repeating pattern along a length of the center region.

6. The playing surface according to claim 1, wherein the first and second shapes are polygons, conic sections, sinusoidal curves, or combinations thereof.

7. A gaming device comprising the playing surface according to claim 1.

8. A pool game comprising the playing surface according claim 1, wherein the playing surface is supported by a housing.

9. A playing surface for a gaming device, comprising:

a flat member with a surface;

a center region of the flat member;

a first end of the center region oppositely disposed of a second end of the center region;

curving regions on left and right sides of the center region;

the curving regions forming edges of the playing surface, the curving regions having a generally flat upper surface which is coplanar to the surface of the flat member, and the curving regions are positioned on the sides of the center region, wherein the center region connects the first end to the second end, and the center region comprising a straight path between the first end and the hole of the second end;

a hole in the second end; and, wherein the playing surface is mostly free of any obstacles that would prevent a ball from falling off the playing surface.

10. The playing surface according to claim 9, wherein the curving regions of the playing surface alternatingly widen and narrow between the first end of the playing surface and the second end of the playing surface.

11. The playing surface according to claim 9, wherein the curving regions are staggered.

12. A gaming device comprising the playing surface according to claim 9.

13. A pool game comprising the playing surface according claim 9, wherein the playing surface is supported by a housing.

14. A pool game, comprising:

a generally flat playing surface, the playing surface comprising a first end oppositely disposed of a second end; the playing surface comprising a center region that connects the first end and the second end; the playing surface comprising variable margins on lateral sides of the center region; the variable margins forming a portion of the generally flat playing surface and edges of the playing surface; wherein the generally flat playing surface is mostly free of any obstacles that would prevent a ball from falling off the upper surface; a scoring hole positioned in the second end;

a housing configured to adjust a level of the playing surface and to tighten the playing surface to a level position;

a first ball;

a second ball; and, the first end of the playing surface receives the first ball and the second ball.

15. A pool game, comprising:

a housing;

a playing surface, the playing surface comprising a first end oppositely disposed of a second end; the playing surface comprising variable margins forming edges and a portion of the playing surface;

the housing configured to maintain the playing surface at a level position;

a main scoring hole in the second end;

a scoring ramp positioned below the playing surface, the scoring ramp including one or more scoring holes; the playing surface configured to allow playing balls to fall from the playing surface to the scoring ramp;

a ball return ramp positioned below the scoring ramp;

a first ball;

a second ball, with a larger diameter than the first ball; and, a blocker over the playing surface, and the blocker prevents the second ball from moving under the blocker.

16. The pool game according to claim 15, further comprising a no-score ramp positioned below the playing surface, wherein the no-score ramp directs the first ball to the ball return ramp.

17. The pool game according to claim 15, wherein the one or more additional scoring holes are positioned between the main scoring hole and the first end.

18. The pool game according to claim 15, wherein the main scoring hole and the one or more additional scoring holes each includes a ball sensor in electrical communication with a processor, and the ball sensor signals the processor when the first ball passes through the scoring hole.

19. The pool game according to claim 15, further comprising a first non-scoring region, a second non-scoring region, and a scoring region, wherein the scoring region is positioned between the first non-scoring region and the second non-scoring region.

20. The pool game according to claim 15, wherein the variable margins are positioned on a right side and a left side of a center region of the playing surface, wherein the center region connects the first end to the second end, wherein the variable margin of the left side comprises a first repeating pattern of a first shape, and wherein the variable margin of the right side comprises a second repeating pattern of the second shape, wherein the first repeating pattern of the first shape and the second repeating pattern of the second shape are offset, and the center region comprising a straight path between the first end and the main scoring hole of the second end.

21. The pool game according to claim 15, wherein the playing surface is mostly free of any obstacles that would prevent a ball from falling off the upper surface.

* * * * *